US009755324B2

(12) United States Patent
Kondo

(10) Patent No.: US 9,755,324 B2
(45) Date of Patent: Sep. 5, 2017

(54) CONTACT INCLUDING A PLURALITY OF CONNECTABLE PARTS

(71) Applicant: HOSIDEN CORPORATION, Yao-shi (JP)

(72) Inventor: Hayato Kondo, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/817,421

(22) Filed: Aug. 4, 2015

(65) Prior Publication Data

US 2016/0043481 A1 Feb. 11, 2016

(30) Foreign Application Priority Data

Aug. 8, 2014 (JP) ..... 2014-163006

(51) Int. Cl.

| | |
|---|---|
| ***H01R 4/10*** | (2006.01) |
| ***H01R 4/16*** | (2006.01) |
| ***H01R 13/11*** | (2006.01) |
| ***H01R 13/6474*** | (2011.01) |

(52) U.S. Cl.
CPC ..... *H01R 4/16* (2013.01); *H01R 13/111* (2013.01); *H01R 13/6474* (2013.01)

(58) Field of Classification Search
CPC ... H01R 13/111; H01R 13/187; H01R 13/113; H01R 4/185; H01R 4/20
USPC ..... 439/842, 843, 852, 877; 174/84 C
See application file for complete search history.

(56) References Cited

U.S. PATENT DOCUMENTS

| | | | | |
|---|---|---|---|---|
| 3,362,008 A | | 1/1968 | Berg | |
| 3,777,051 A | * | 12/1973 | Ziegler, Jr. | H01R 4/62 174/84 C |
| 4,923,416 A | * | 5/1990 | Zinn | H01R 13/052 439/877 |
| 5,516,311 A | * | 5/1996 | Maejima | H01R 13/4223 439/877 |
| 5,860,836 A | | 1/1999 | Ohno | |

(Continued)

FOREIGN PATENT DOCUMENTS

| | | |
|---|---|---|
| DE | 19544131 A1 | 6/1996 |
| JP | 2010-177125 A | 8/2010 |

OTHER PUBLICATIONS

Extended European Search Report issued on Nov. 25, 2015 for the counterpart European patent application No. 15020130.9.

*Primary Examiner* — Thanh Tam Le
(74) *Attorney, Agent, or Firm* — Kratz, Quintos & Hanson, LLP

(57) ABSTRACT

A contact including a first connectable part, a second connectable part, and a middle part. The first connectable part includes a tube or plate. The plate has a cross section generally of U-shape, V-shape, C-shape, or L-shape. The tube or the plate includes a base and a first wall. The first wall extends from a first end portion of the base. The middle part includes a base and a first sloped portion. The base of the middle part is contiguously connected between the base of the first connectable part and the second connectable part. The first sloped portion is contiguously connected between the first wall and a first end portion of the second connectable part. The first sloped portion extends from a first end portion of the base of the middle part such that the first sloped portion slopes down toward the first end portion of the second connectable part.

20 Claims, 5 Drawing Sheets

(56) References Cited

U.S. PATENT DOCUMENTS

| | | | | | |
|---|---|---|---|---|---|
| 6,004,171 | A * | 12/1999 | Ito | H01R 4/184 | 439/877 |
| 6,068,527 | A * | 5/2000 | Ohsumi | H01R 4/185 | 439/877 |
| 6,086,434 | A * | 7/2000 | Rollero | H01R 13/11 | 439/842 |
| 6,093,034 | A | 7/2000 | Tan | | |
| 6,200,174 | B1 * | 3/2001 | Katoh | H01R 4/4818 | 439/843 |
| 6,261,134 | B1 * | 7/2001 | Muzslay | H01R 43/16 | 29/857 |
| 6,558,208 | B2 * | 5/2003 | Suzuki | H01R 4/185 | 439/852 |
| 6,755,697 | B2 * | 6/2004 | Kojima | H01R 13/187 | 439/595 |
| 7,077,712 | B2 * | 7/2006 | Sakaguchi | H01R 4/185 | 439/877 |
| 7,118,429 | B1 * | 10/2006 | Fabian | H01R 4/4818 | 439/438 |
| 7,121,903 | B2 * | 10/2006 | Sakaguchi | H01R 4/185 | 439/877 |
| 7,137,854 | B2 * | 11/2006 | Casses | H01R 13/113 | 439/852 |
| 7,419,409 | B2 * | 9/2008 | Machida | H01R 13/4367 | 439/852 |
| 7,803,008 | B2 * | 9/2010 | Onuma | H01R 4/185 | 439/442 |
| 2013/0126236 | A1 | 5/2013 | Suzuki | | |

* cited by examiner

CONTACT INCLUDING A PLURALITY OF CONNECTABLE PARTS

CROSS-REFERENCE TO RELATED APPLICATIONS

The present application claims priority under 35 U.S.C. §119 of Japanese Patent Application No. 2014-163006 filed on Aug. 8, 2014, the disclosure of which is expressly incorporated by reference herein in its entity.

BACKGROUND OF THE INVENTION

Technical Field

The invention relates to contacts.

Background Art

Japanese Unexamined Patent Publication No. 2010-177125 describes a conventional contact. The contact is formed of a metal plate. The contact includes a first connectable part, a second connectable part, and a middle part between the first and second connectable parts. The first connectable part is a rectangular tube and connectable to a terminal of a connector etc. The second connectable part is a generally U-shaped plate with two distal ends. When the second connectable part receives a core of a cable, the front ends are crimped toward the core. The middle part is a generally U-shaped plate and has a smaller height than those of the first and second connectable parts.

SUMMARY OF INVENTION

The above conventional contact is shaped such as to sharply change at the boundaries between the first connectable part and the middle part and between the middle part and the second connectable part. Specifically, there is a sharp drop in height at the boundary between the first connectable part and the middle part and a sharp rise in height at the boundary between the middle part and the second connectable part. These sharp changes cause sharp changes in impedance at these boundaries. When the conventional contact is used to transmit high-frequency signals, the above-mentioned sharp impedance changes can cause reflection of the high-frequency signals.

In the circumstances, the invention provides a contact capable of reducing reflection of high-frequency signals.

A contact in an aspect of the invention includes a first connectable part, a second connectable part, and a middle part. The first connectable part includes a tube or plate extending in a first direction. The plate has a cross section generally of U-shape, V-shape, C-shape, or L-shape. The tube or the plate includes a base and a first wall. The base includes a first end portion on one side of a second direction, the second direction being orthogonal to the first direction. The first wall extends from the first end portion of the base in a direction containing a component of a third direction, the third direction being orthogonal to the first and second directions. The second connectable part is a plate extending in the first direction and includes a first end portion on one side of the second direction. The middle part includes a base and a first sloped portion. The base of the middle part is contiguously connected between the base of the first connectable part and the second connectable part and includes a first end portion on the one side of the second direction. The first sloped portion is contiguously connected between the first wall of the first connectable part and the first end portion of the second connectable part. The first sloped portion extends from the first end portion of the base of the middle part in a direction containing a component of the third direction such that the first sloped portion slopes down toward the first end portion of the second connectable part.

The contact of this aspect can reduce reflection of high-frequency signals transmitted through the contact for the following reasons. The first sloped portion of the middle part slopes down toward the first end portion of the second connectable part. Accordingly, the contact gently changes in shape at the boundary between the first wall of the first connectable part and the first sloped portion of the middle part (first boundary) and at the boundary between the first sloped portion of the middle part and the first end portion of the second connectable part (second boundary). This configuration can reduce sharp changes of impedances at the first and second boundaries and thus reduce reflection of high-frequency signals.

The first sloped portion may have a slope angle of not greater than about 60 degrees relative to a first imaginary line. The first imaginary line may extend in the first direction through a boundary between the first sloped portion and the first end portion of the second connectable part. The contact of this aspect gently changes in shape, particularly from the first wall of the first connectable part to the first sloped portion of the middle part and from the first sloped portion of the middle part to the first end portion of the second connectable part. This configuration can further reduce sharp changes of impedances at the first and second boundaries of the contact, resulting in further reduced reflection of high-frequency signals.

The first sloped portion may have a slope angle of not greater than about 45 degrees relative to the first imaginary line. The contact of this aspect gently changes in shape, particularly from the first wall of the first connectable part to the first sloped portion of the middle part and from the first sloped portion of the middle part to the first end portion of the second connectable part. This configuration can further reduce sharp changes of impedances at the first and second boundaries of the contact, resulting in further reduced reflection of high-frequency signals.

The first end portion of the second connectable part may extend relative to the first connectable part to the one side of the second direction or be recessed relative to the first connectable part to the other side of the second direction. The contact of this aspect can further reduce reflection of high-frequency signals because of an increased distance between the first wall of the first connectable part and the first end portion of the second connectable part. The contact accordingly has a gentle slope angle of the first sloped portion, i.e. has gentle changes in shape, particularly from the first wall of the first connectable part to the first sloped portion of the middle part and from the first sloped portion of the middle part to the first end portion of the second connectable part. It is therefore possible to further reduce sharp changes of impedances at the first and second boundaries.

The first wall of the first connectable part may curve or bend to the other side of the second direction. The contact of this aspect can further reduce reflection of high-frequency signals because of an increased distance between the first wall of the first connectable part and the first end portion of the second connectable part. The contact accordingly has a gentle slope angle of the first sloped portion, i.e. has gentle changes in shape, particularly from the first wall of the first connectable part to the first sloped portion of the middle part and from the first sloped portion of the middle part to the first end portion of the second connectable part. It is therefore possible to further reduce sharp changes of impedances at the first and second boundaries.

The plate of the first connectable part may have a cross section generally of U-shape, V-shape, or C-shape. The base of the first connectable part may further include a second end portion on the other side of the second direction. The tube or the plate of the first connectable part may further include a second wall extending from the second end portion of the base of the first connectable part in a direction containing a component of the third direction. The second connectable part may further include a second end portion on the other side of the second direction. The base of the middle part may further include a second end portion on the other side of the second direction. The middle part may further include a second sloped portion contiguously connected between the second wall of the first connectable part and the second end portion of the second connectable part. The second sloped portion may extend from the second end portion of the base of the middle part in a direction containing a component of the third direction such that the second sloped portion slopes down toward the second end portion of the second connectable part.

The contact of this aspect can reduce reflection of high-frequency signals transmitted though the contact for the following reasons. The first sloped portion of the middle part slopes down toward the first end portion of the second connectable part, and the second sloped portion of the middle part slopes down toward the second end portion of the second connectable part. Accordingly, the contact gently changes in shape at the boundary between the first wall of the first connectable part and the first sloped portion of the middle part (first boundary), the boundary between the first sloped portion of the middle part and the first end portion of the second connectable part (second boundary), the boundary between the second wall of the first connectable part and the second sloped portion of the middle part (third boundary), and the boundary between the second sloped portion of the middle part and the second end portion of the second connectable part (fourth boundary). This configuration can reduce sharp changes of impedances of the contact at the first to fourth boundaries, resulting in reduced reflection of high-frequency signals.

The first sloped portion may have a slope angle of not greater than about 60 degrees relative to a first imaginary line. The first imaginary line may extend in the first direction through a boundary between the first sloped portion and the first end portion of the second connectable part. The second sloped portion may have a slope angle of not greater than about 60 degrees relative to a second imaginary line. The second imaginary line may extend in the first direction through a boundary between the second sloped portion and the second end portion of the second connectable part. The contact of this aspect can further reduce reflection of high-frequency signals for the following reasons. With the slope angle of the first sloped portion being not greater than about 60 degrees relative to the first imaginary line, the contact gently changes in shape, particularly from the first wall of the first connectable part to the first sloped portion of the middle part, and from the first sloped portion of the middle part to the first end portion of the second connectable part. With the slope angle of the second sloped portion being not greater than about 60 degrees relative to the second imaginary line, the contact gently changes in shape also from the second wall of the first connectable part to the second sloped portion of the middle part and from the second sloped portion of the middle part to the second end portion of the second connectable part. This configuration can further reduce sharp changes of impedances at the first to fourth boundaries, resulting in further reduced reflection of high-frequency signals.

The first sloped portion may have a slope angle of not greater than about 45 degrees relative to the first imaginary line. The second sloped portion may have a slope angle of not greater than about 45 degrees relative to the second imaginary line. The contact of this aspect can further reduce reflection of high-frequency signals for the following reasons. With the slope angle of the first sloped portion being not greater than about 45 degrees relative to the first imaginary line, the contact gently changes in shape, particularly from the first wall of the first connectable part to the first sloped portion of the middle part, and from the first sloped portion of the middle part to the first end portion of the second connectable part. With the slope angle of the second sloped portion being not greater than about 45 degrees relative to the second imaginary line, the contact gently changes in shape, also from the second wall of the first connectable part to the second sloped portion of the middle part, and from the second sloped portion of the middle part to the second end portion of the second connectable part. This configuration can further reduce sharp changes of impedances at the first to fourth boundaries, resulting in further reduced reflection of high-frequency signals.

The second connectable part may be different from the first connectable part in dimension in the second direction.

The contact of this aspect can further reduce reflection of high-frequency signals. With the second connectable part having a different dimension in the second direction from that of the first connectable part, the distances are increased from the first wall of the first connectable part to the first end portion of the second connectable part and from the second wall of the first connectable part to the second end portion of the second connectable part. The contact accordingly has a gentle slope angle of the first sloped portion, i.e. has gentle changes in shape, particularly from the first wall of the first connectable part to the first sloped portion of the middle part and from the first sloped portion of the middle part to the first end portion of the second connectable part. The contact also has a gentle slope angle of the second sloped portion, i.e. has gentle changes in shape from the second wall of the first connectable part to the second sloped portion of the middle part and from the second sloped portion of the middle part to the second end portion of the second connectable part. It is therefore possible to further reduce sharp changes of impedances at the first to fourth boundaries of the contact, resulting in further reduced reflection of high-frequency signals.

The first wall of the first connectable part may curve or bend to the other side of the second direction. The second wall of the first connectable part may curve or bend to the one side of the second direction.

The contact of this aspect can further reduce reflection of high-frequency signals for the following reasons. With the first wall curving or bending to the other side of the second direction, the distance is increased from the first wall of the first connectable part to the first end portion of the second connectable part. The contact accordingly has a gentle slope angle of the first sloped portion, i.e. has gentle changes in shape, particularly from the first wall of the first connectable part to the first sloped portion of the middle part and from the first sloped portion of the middle part to the first end portion of the second connectable part. With the second wall curving or bending to the one side of the second direction, the distance is increased from the second wall of the first connectable part to the second end portion of the second connectable part. The contact accordingly has a gentle slope angle of the second sloped portion, i.e. has gentle changes in shape from the second wall of the first connectable part to the second sloped portion of the middle part and from the second sloped portion of the middle part to the second end portion of the second connectable part. It is therefore possible to further reduce sharp changes of impedances at the first to fourth boundaries of the contact.

The tube or the plate of the first connectable part may include a first end coupled to the middle part and a second end opposite to the first end. The first connectable part may further include at least two arms extending in the first direction from the second end of the tube or the plate. The arms may be opposed to each other and elastically deformable in directions away from each other.

The contact of this aspect can hold between its arms an object to be connected to the contact.

The contact may be configured such that the first wall includes a distal face, the distal face facing in a direction including a component of the other side of the second direction or in a direction including a component of one side of the third direction; the first end portion of the second connectable part includes an end face on the one side of the second direction; the first sloped portion includes a sloped face, and the sloped face slopes down from an end on one side of the first direction of the distal face of the first wall of the first connectable part to the end face of the first end portion of the second connectable part.

Alternatively, the contact may be configured such that the first wall includes a distal face, the distal face facing in a direction including a component of the other side of the second direction or in a direction including a component of one side of the third direction; the first end portion of the second connectable part includes an end face on the one side of the second direction; the first sloped portion includes a sloped face; the sloped face of the first sloped portion slopes down from an end on one side of the first direction of the distal face of the first wall of the first connectable part to the end face of the first end portion of the second connectable part; the second wall includes a distal face, the distal face of the second wall facing in a direction including a component of the one side of the second direction or in a direction including a component of the one side of the third direction; the second end portion of the second connectable part includes an end face on the other side of the second direction; the second sloped portion includes a sloped face; and the sloped face of the second sloped portion slopes down from an end on one side of the first direction of the distal face of the second wall of the first connectable part to the end face of the second end portion of the second connectable part.

Still alternatively, the contact may be configured such that the first wall includes a distal face facing to the other side in the second direction; the first end portion of the second connectable part includes an end face on the one side of the second direction; the first sloped portion includes a sloped face; and the sloped face extends to the one side of the second direction from an end on one side of the first direction of the distal face of the first wall of the first connectable part and then slopes down to the end face of the first end portion of the second connectable part.

Still alternatively, the contact may be configured such that the first wall includes a distal face facing to in a direction including components of the other side of the second direction and the other side of the third direction; the first end portion of the second connectable part includes an end face on the one side of the second direction; the first sloped portion includes a sloped face; and the sloped face slopes up, in a direction including a component of the one side of the third direction, from an end on one side of the first direction of the distal face of the first wall of the first connectable part and then slopes down to the end face of the first end portion of the second connectable part.

Figure 1A:
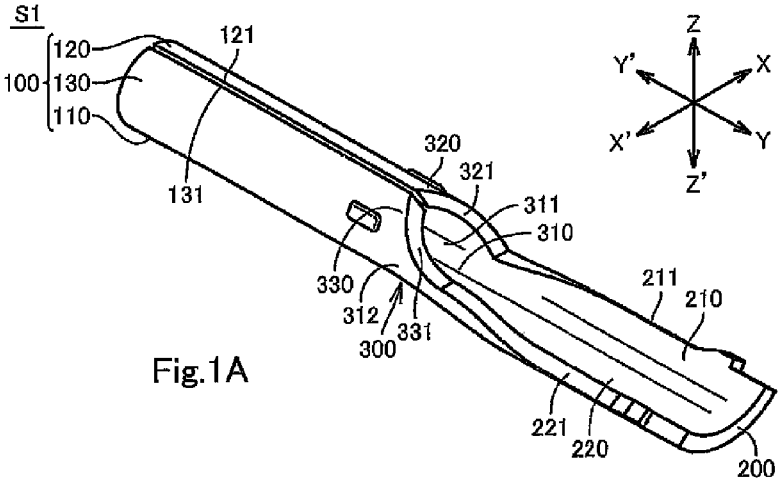
FIG. 1A is a perspective view of a contact in the first embodiment of the invention.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the contact and its constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

The first to sixth embodiments of the invention will be described below.

First Embodiment

A contact S1 in accordance with the first embodiment of the invention will be described with reference to FIG. 1A to FIG. 1E. The contact S1 is formed of a metal plate having electrical conductivity. The contact S1 includes a first connectable part 100, a second connectable part 200, and a middle part 300. These components of the contact S1 will be described below in detail. It should be appreciated that the Y-Y' direction indicated in FIG. 1A to FIG. 1C corresponds to the longitudinal direction of the contact S1 and to the "first direction" recited in the claims. Of the Y-Y' direction, the Y direction corresponds to one side of the first direction, and the Y' direction corresponds to the other side of the first direction. The X-X' direction indicated in FIG. 1A, FIG. 1D and FIG. 1E corresponds to the lateral direction of the contact S1 and to the "second direction" recited in the claims. Of the X-X' direction, the X direction corresponds to one side of the second direction, and the X' direction corresponds to the other side of the second direction. The X-X' direction is orthogonal to the Y-Y' direction. The Z-Z' direction corresponds to the height direction of the contact S1 and to the "third direction" recited in the claims. Of the Z-Z' direction, the Z direction corresponds to one side of the third direction, and the Z' direction corresponds to the other side of the third direction. The Z-Z' direction is orthogonal to the Y-Y' and X-X' directions.

Figure 1B:
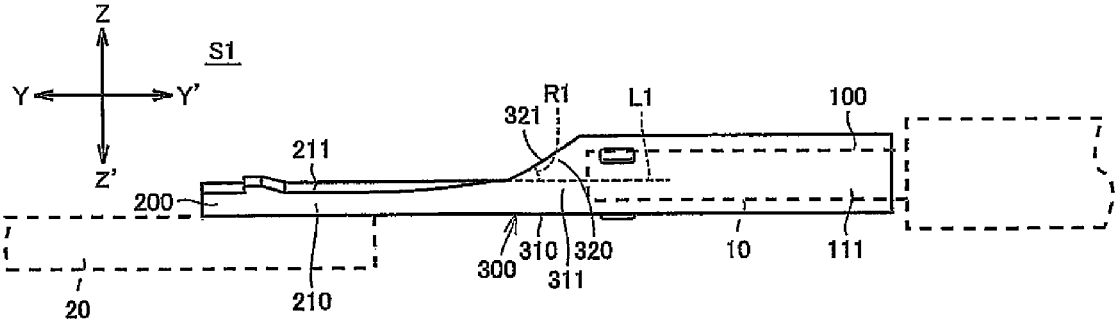
FIG. 1B is a right side view of the contact.
Figure 1C:
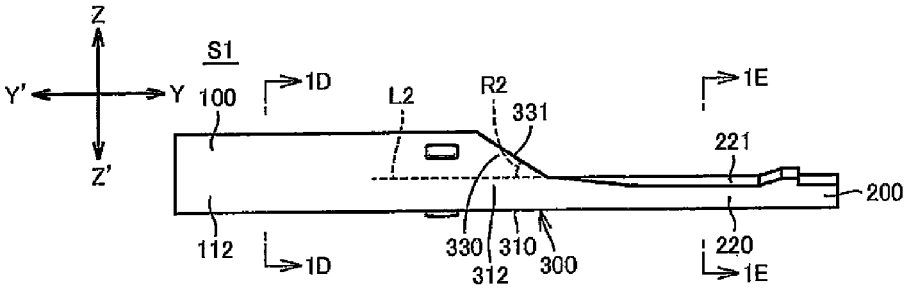
FIG. 1C is a left side view of the contact.

As illustrated in FIG. 1A and FIG. 1C, the first connectable part 100 is a circular tube extending in the Y-Y' direction. The first connectable part 100 includes a base 110, a first wall 120, and a second wall 130.

Figure 1D:
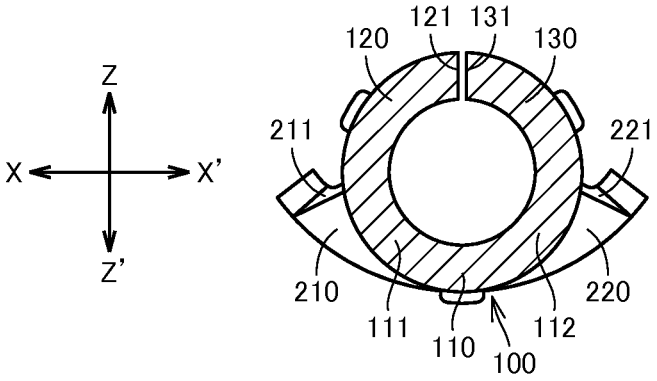
FIG. 1D is a sectional view of the contact, taken along 1D-1D in FIG. 1C.
Figure 1E:
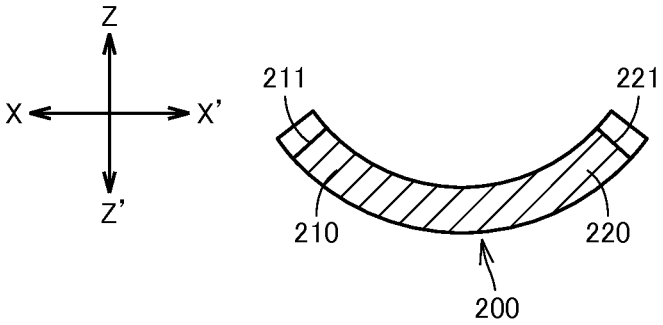
FIG. 1E is a sectional view of the contact, taken along 1E-1E in FIG. 1C.

As best illustrated in FIG. 1D, the base 110 is a plate of arc-shaped cross-section protruding in the Z' direction. The base 110 constitutes the bottom of the circular tube. The base 110 includes a first end portion 111 on the X-direction side and a second end portion 112 on the X'-direction side.

The first wall 120 is a plate of arc-shaped cross-section, extending from the first end portion 111 of the base 110 in the Z direction and curving in the X' direction. The second wall 130 is a plate of arc-shaped cross-section, extending from the second end portion 112 of the base 110 in the Z direction and curving in the X direction. The distal face 121 of the first wall 120 and the distal face 131 of the second wall 130 face each other, with a clearance therebetween as illustrated in FIG. 1D, or alternatively in abutment with each other. The distal face 121 faces in the X' direction, and the distal face 131 faces in the X direction. In the tuboid first connectable part 100, the first wall 120 consists of the side wall on the X-direction side and a half of the top on the X-direction side of the circular tube, while the second wall 130 consists of the side wall on the X'-direction side and the other half of the top on the X'-direction side of the circular tube.

As illustrated in FIG. 1A to FIG. 1E, the second connectable part 200 is a plate extending in the Y-Y' direction and having a cross-section of arc shape protruding in the Z' direction. The second connectable part 200 is disposed on the Y-direction side and at a distance from the first connectable part 100. The second connectable part 200 includes a first end portion 210 on the X-direction side and a second end portion 220 on the X'-direction side. The second connectable part 200 is different in X-X' direction dimension from the first connectable part 100. In other words, the first end portion 210 may extend to the X-direction side relative to the first connectable part 100, and the second end portion 220 may extend to the X'-direction side relative to the first connectable part 100. Alternatively, the first end portion 210 may be recessed to the X'-direction side relative to the first connectable part 100, and the second end portion 220 may be recessed to the X-direction side relative to the first connectable part 100. In the first embodiment, the second connectable part 200 is larger in the X-X' direction than the first connectable part 100 as best illustrated in FIG. 1D.

The first end portion 210 has an end face 211 on the X-direction side. The second end portion 220 has an end face 221 on the X'-direction side. The second connectable part 200 is a plate of arc-shaped cross-section as described above, the end face 211 is oriented in a direction containing components of the X and Z directions, and the end face 221 is oriented in a direction containing components of the X' and Z directions.

As illustrated in FIG. 1A to FIG. 1C, the middle part 300 is contiguously connected between the first connectable part 100 and the second connectable part 200. The middle part 300 includes a base 310, a first sloped portion 320, and a second sloped portion 330.

The base 310 is a plate extending in the Y-Y' direction from the base 110 of the first connectable part 100 to the second connectable part 200 and having a cross section of arc shape protruding in the Z' direction. The base 310 forms the bottom of the middle part 300. The base 310 is contiguously connected between the base 110 of the first connectable part 100 and the second connectable part 200. The base 310 includes a first end portion 311 on the X-direction side and a second end portion 312 on the X'-direction side.

The first sloped portion 320 is a plate (side plate) of arc-shaped cross-section, extending from the first end portion 311 of the base 310 in the Z direction and curving in the X' direction. The first sloped portion 320 is contiguously connected between the first wall 120 of the first connectable part 100 and the first end portion 210 of the second connectable part 200. The first sloped portion 320 slopes down from the first wall 120 to the first end portion 210 of the second connectable part 200, i.e. slopes in the Y and Z' directions.

The first sloped portion 320 includes a sloped face 321. The sloped face 321 extends from the Y-direction end of the distal face 121 of the first wall 120 to the end face 211 of the first end portion 210. The sloped face 321 curves in the X direction and slopes down from the Y-direction end of the distal face 121 of the first wall 120 to the end face 211 of the first end portion 210. As described above, the first wall 120 of the first connectable part 100 is an arc-shaped plate extending in the Z direction and curving in the X' direction, and the first end portion 210 of the second connectable part 200 extends to the X-direction side relative to the first connectable part 100. This configuration is advantageous in providing a gentle slope angle R1 of the first sloped portion 320, i.e. lengthening the sloped face 321.

The slope angle R1 of the first sloped portion 320 is less than 90 degrees, preferably not greater than about 60 degrees, and more preferably not greater than about 45 degrees, relative to the following first imaginary line L1. As illustrated in FIG. 1B, the first imaginary line L1 is a line extending in the Y-Y' direction through the boundary between the first sloped portion 320 and the first end portion 210 of the second connectable part 200, i.e. through the Z' direction-end (lower end) of the first sloped portion 320.

The second sloped portion 330 is a plate of arc-shaped cross-section (side plate), extending from the second end portion 312 of the base 310 in the Z-direction and curving in the X direction. The second sloped portion 330 is contiguously connected between the Y-direction end of the second wall 130 of the first connectable part 100 and the second end portion 220 of the second connectable part 200. The second sloped portion 330 slopes down, i.e. slopes in the Y and Z' directions, from the second wall 130 to the second end portion 220 of the second connectable part 200.

The second sloped portion 330 includes a sloped face 331. The sloped face 331 extends from the Y-direction end of the distal face 131 of the second wall 130 to the end face 221 of the second end portion 220. The sloped face 331 curves in the X' direction and slopes down from the Y-direction end of the distal face 131 of the second wall 130 to the end face 221 of the second end portion 220. As described above, the second wall 130 of the first connectable part 100 is an arc-shaped plate extending in the Z direction and curving in the X direction, and the second end portion 220 of the second connectable part 200 extends to the X'-direction side relative to the first connectable part 100. This configuration is advantageous in providing a gentle slope angle R2 of the second sloped portion 330, i.e. lengthening the sloped face 331.

The slope angle R2 of the second sloped portion 330 is less than 90 degrees, preferably not greater than about 60 degrees, and more preferably not greater than about 45 degrees, relative to the following second imaginary line L2. As illustrated in FIG. 1C, the second imaginary line L2 is a line extending in the Y-Y' direction through the boundary between the second sloped portion 330 and the second end portion 220 of the second connectable part 200, i.e. through Z' direction-end (lower end) of the second sloped portion 330.

The contact S1 configured as described above can be manufactured in the following manner. First, a metal plate is prepared and stamped into shape using a die not shown. More particularly, a portion on the Y' direction side of the metal plate is shaped into a circular tube to become the first connectable part 100; a portion on the Y direction side of the metal plate is shaped into an arc shape in sectional view to become the second connectable part 200; and a portion between the portions on the Y' and Y direction sides of the metal plate is shaped into an arc shape in sectional view to become the middle part 300.

The contact S1 can be used in the following manner. The contact S1 is held by a body of a connector not shown. A cable core 10 or a pin not shown is inserted into the first connectable part 100 of the contact S1 to electrically and mechanically connect the first connectable part 100 to the cable core or pin. The second connectable part 200 of the contact S1 is soldered to a circuit board 20 for mounting a connector. The second connectable part 200 may be soldered to a cable core or a pin.

The inventor conducted a comparative study between the contact S1 and a comparison contact using a simulation system. Impedances were compared between the contact S1 and the comparison contact, as held in a body of a connector. The contact S1 used here is configured to have the first and second sloped portion 320, 330 of slope angles R1, R2 of 45 degrees. The comparison contact has the same configuration as the contact S1, except that the comparison contact has vertical portions at 90 degree angles relative to the first and second imaginary lines L1, L2, in place of the first and second sloped portions 320, 330. The simulation demonstrated that the first and second sloped portions 320, 330 of the contact S1 can reduce impedances by about 5Ω as compared with the vertical portions of the comparison contact.

The contact S1 has at least the following technical features and effects. First, the contact S1 can be used to transmit high-frequency signals with reduced possibility that the signals will be reflected. This is because the first and second sloped portions 320, 330 of the middle part 300 of the contact S1 gently slope down from the first connectable part 100 to the second connectable part 200. In other words, the contact S1 is shaped such as to gently change (such as not to sharply change) at a first boundary between the first wall 120 of the first connectable part 100 and the first sloped portion 320 of the middle part 300, and at a second boundary between the first sloped portion 320 of the middle part 300 and the first end portion 210 of the second connectable part 200, and such as to gently change (such as not to sharply change) at a third boundary between the second wall 130 of the first connectable part 100 and the second sloped portion 330 of the middle part 300, and at a fourth boundary between the second sloped portion 330 of the middle part 300 and the second end portion 220 of the second connectable part 200. For this reason, impedances should change gently at the first, second, third, and fourth boundaries of the contact S1. This contributes to reduced reflection of high-frequency signals transmitted through the contact S1.

Second, the contact S1 is designed such that the first and second sloped portions 320, 330 have gentle slope angles R1, R2. More particularly, the first and second walls 120, 130 of the first connectable part 100 are arc-shaped in cross-section and the second connectable part 200 is larger in the X-X' direction than the first connectable part 100. This configuration makes it possible to lengthen the sloped faces 321, 331 of the first and second sloped portions 320, 330, with gentle slope angles R1, R2 of the first and second sloped portions 320, 330.

Second Embodiment

Figure 2A:
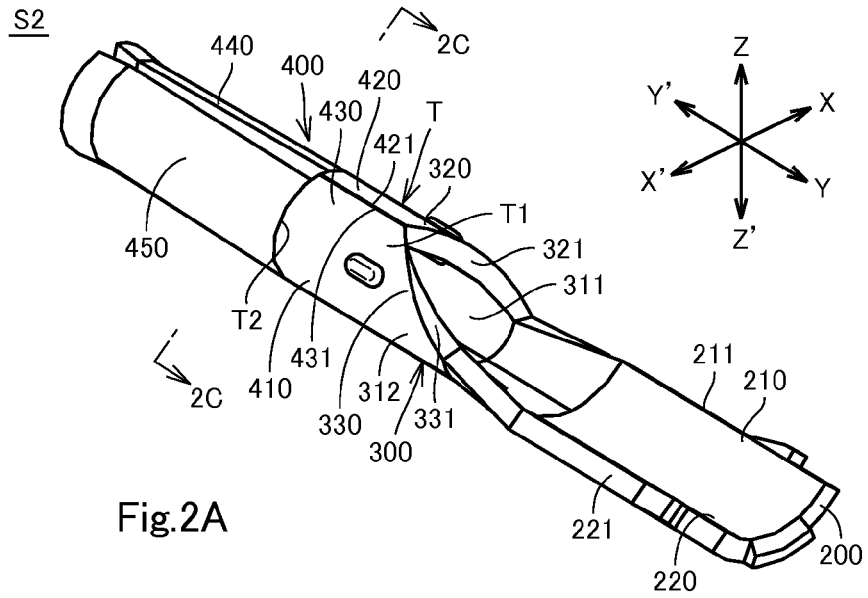
FIG. 2A is a perspective view of a contact in the second embodiment of the invention.
Figure 2B:
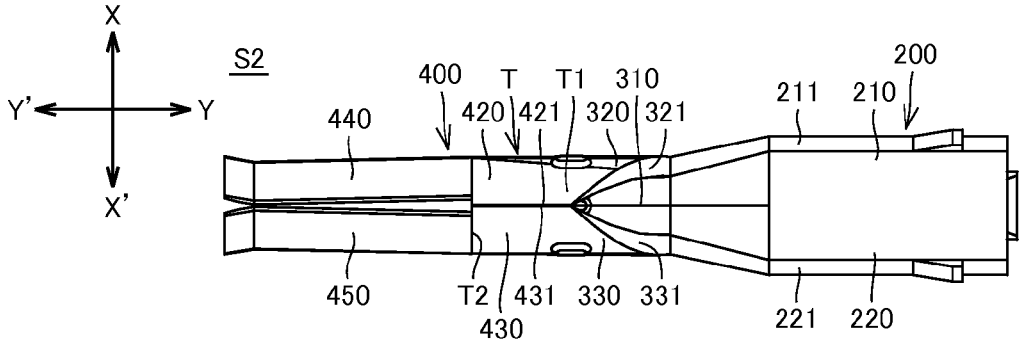
FIG. 2B is a plan view of the contact.
Figure 2C:
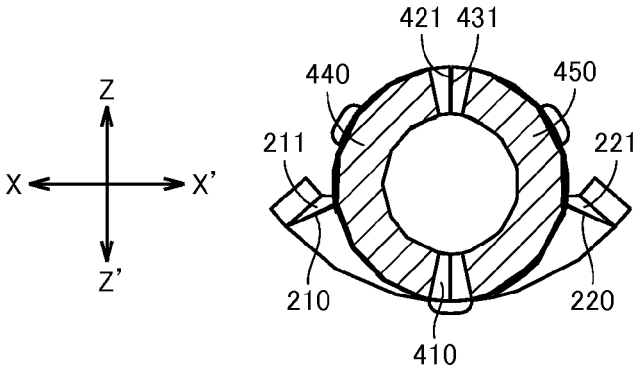
FIG. 2C is a sectional view of the contact, taken along 2C-2C in FIG. 2A.

A contact S2 in accordance with the second embodiment of the invention will be described with reference to FIG. 2A to FIG. 2C. The contact S2 is formed of a metal plate having electrical conductivity. The contact S2 has the same configuration as the contact S1, except that the contact S2 includes a first connectable part 400 of different configuration from that of the first connectable part 100 of the contact S1 of the first embodiment. The differences will be described below in detail and overlapping descriptions will be omitted. The Y-Y' direction and the X-X' direction are indicated in FIG. 2A to FIG. 2B, the Z-Z' direction is indicated in FIG. 2A to FIG. 2B in a similar manner as in the first embodiment.

The first connectable part 400 includes a tube T and a pair of arms 440, 450. The tube T has substantially the same configuration as that of the first connectable part 100 of the first embodiment. As shown in FIG. 2A to FIG. 2B, the tube T includes a base 410, a first wall 420, and a second wall 430. The first wall 420 has a distal face 421, and the second wall 430 has a distal face 431. The tube T has a Y-direction side end T1 (the "first end" as recited in the claims) and a Y'-direction side end T2 (the end T2 opposite from the end T1, the "second end" as recited in the claims). The end T1 is connected to the middle part 300 in a similar manner to the first connectable part 100 of the first embodiment.

The arms 440, 450 are plates extending from the end T2 in the Y' direction and having a cross section of arc shape. The arms 440, 450 are opposed to each other and slope so as to be closer to each other in the Y direction. The arms 440, 450 are elastically deformable so as to be away from each other.

The contact S2 configured as described above can be manufactured in the following manner. First, a metal plate is prepared and stamped into shape using a die not shown. In the stamped metal plate, the end portion on Y'-direction side is cut in two pieces to become the arc-shaped arms 440, 450 of the first connectable part 400, a portion on the Y-direction side from the two pieces is shaped into a circular tube to become the tube T of the first connectable part 400, the end portion of the Y-direction side is shaped into arc shape in sectional view to become the second connectable part 200, and the portion between the tube T and the Y-direction side end is shaped into arc shape in sectional view to become the middle part 300.

The contact S2 is can be used in a similar manner to the contact S1, more particularly as described below. A cable core or a pin can be inserted between the arms 440, 450 of the first connectable part 400, so that the arms 440, 450 elastically deform so as to be away from each other and hold the cable core or pin. As in the contact S1, the second connectable part 200 can be soldered to a circuit board, a cable core, or a pin.

The contact S2 has the same technical features and effects as those of the contact S1.

Third Embodiment

Figure 3:
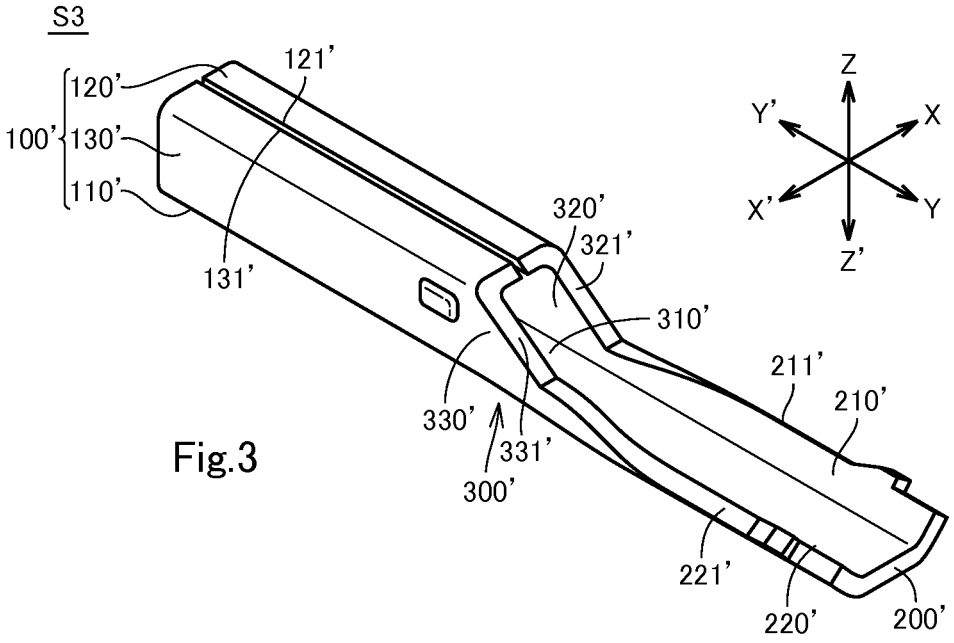
FIG. 3 is a perspective view of a contact in the third embodiment of the invention.

A contact S3 in accordance with the third embodiment of the invention will be described below with reference to FIG. 3. The contact S3 is formed of a metal plate having electrical conductivity. The contact S3 has a similar configuration as the contact S1 but includes a first connectable part 100', a second connectable part 200', and a middle part 300' of different shapes from those of the first connectable part 100, the second connectable part 200, and the middle part 300, respectively, of the contact S1 in the first embodiment. The differences will be described below in detail and overlapping descriptions will be omitted. The Y-Y' direction, the X-X' direction, and the Z-Z' direction are indicated in FIG. 3 in a similar manner as in the first embodiment.

The first connectable part 100' is a rectangular tube extending in the Y-Y' direction. The base 110' of the first connectable part 100' is a plate of generally angular U-shape in sectional view. The first wall 120' of the first connectable part 100' is a plate extending from the first end portion on X-direction side of the base 110' in the Z direction and further extending in the X' direction. That is, the first wall 120' of the first connectable part 100' is bent in the X' direction. The second wall 130' of the first connectable part 100' is a plate extending from the second end portion on the X'-direction side of the base 110' in the Z direction and further extending in the X direction. That is, the second wall 130' of the first connectable part 100' is bent in the X direction.

The second connectable part 200' extends in the Y-Y' direction and is generally angular U-shaped in sectional view. The first end portion 210' on the X-direction side of the second connectable part 200' extends obliquely in a direction containing components of the X and Z directions. The end face 211' on the X-direction side of the first end portion 210' faces in a direction containing components of the X and Z directions. The second end portion 220' on the X'-direction side of the second connectable part 200' extends obliquely in a direction containing components of the X' and Z directions. The end face 221' on the X'-direction side of the second end portion faces in a direction containing components of the X' and Z directions.

The second connectable part 200' is different in X-X' direction dimension from the first connectable part 100'. In other words, the first end portion 210' may extend relative to the X-direction side than the first connectable part 100', and the second end portion 220' may extend relative to the X'-direction side than the first connectable part 100'. Alternatively, the first end portion 210' may be recessed relative to the first connectable part 100' to the X'-direction side, and the second end portion 220' may be recessed relative to the first connectable part 100' to the X-direction side. In the first embodiment, the second connectable part 200' is larger in the X-X' direction than the first connectable part 100'.

The base 310' of the middle part 300' is a plate extending in the Y-Y' direction from the base 110' of the first connectable part 100' to the second connectable part 200' and being generally of angular U-shape in sectional view. The base 310' is contiguously connected between the second connectable part 200' and the base 110' of the first connectable part 100'.

The first sloped portion 320' of the middle part 300' is a plate extending in the Z direction from the first end portion on the X-direction side of the base 310' and further extending in the X' direction. The first sloped portion 320' is contiguously connected between the first wall 120' of the first connectable part 100' and the first end portion 210' of the second connectable part 200'. The first sloped portion 320' slopes down, i.e. slopes in the Y and Z' directions, from the first wall 120' to the first end portion 210' of the second connectable part 200'.

The sloped face 321' of the first sloped portion 320' extends in the X' direction from the Y-direction end of the distal face 121' of the first wall 120' and then slopes down to the end face 211' of the first end portion 210'. As described above, the first wall 120' of the first connectable part 100' is a plate bent in the X' direction, and the first end portion 210' of the second connectable part 200' extends in the X direction relative to the first connectable part 100'. This configuration is advantageous in providing a gentle slope angle R1 of the first sloped portion 320', i.e. lengthening the sloped face 321'. As in the first embodiment, the slope angle of the first sloped portion 320' is preferably not greater than about 60 degrees, more preferably not greater than about 45 degrees, relative to the first imaginary line (not shown).

The second sloped portion 330' of the middle part 300' is a plate extending in the Z direction from the second end portion on the X'-direction side of the base 310' and further extending in the X direction. The second sloped portion 330' is contiguously connected between the Y-direction end of the second wall 130' of the first connectable part 100' and the second end portion 220' of the second connectable part 200'. The second sloped portion 330' slopes down, i.e. slopes in the Y and Z' directions, from the second wall 130' to the second end portion 220' of the second connectable part 200'.

The sloped face 331' of the second sloped portion 330' extends in the X direction from the Y-direction end of the distal face 131' of the second wall 130' and then slopes down to the end face 221' of the second end portion 220'. As described above, the second wall 130' of the first connectable part 100' is the plate bent in the X direction, and the second end portion 220' of the second connectable part 200' extends in the X' direction relative to the first connectable part 100'. This configuration is advantageous in providing a gentle slope angle of the second sloped portion 330', i.e. lengthening the sloped face 331'. As in the first embodiment, the slope angle of the second sloped portion 330' is preferably not greater than about 60 degrees, more preferably not greater than about 45 degrees, relative to the second imaginary line (not shown).

The contact S3 configured as described above can be manufactured in the following manner. First, a metal plate is prepared and stamped into shape using a die not shown. More particularly, a portion on the Y' direction side of the metal plate is shaped into a rectangular tuboid shape to become the first connectable part 100'; a portion on the Y direction side of the metal plate is shaped into a generally angular U-shape in sectional view to become the second connectable part 200'; and a portion between the portions on the Y' and Y direction sides of the metal plate is shaped into a generally angular U-shape in sectional view to become the middle part 300'.

The contact S3 can be used in a similar manner to the contact S1, more particularly as described below. A cable core or a pin not shown is inserted into the first connectable part 100' of the contact S3 to electrically and mechanically connect the first connectable part 100' to the cable core or pin. The second connectable part 200' of the contact S3 is soldered to a circuit board for mounting a connector. The second connectable part 200' may be soldered to a cable core or a pin.

The contact S3 has the same technical features and effects as those of the contact S1.

Fourth Embodiment

Figure 4:
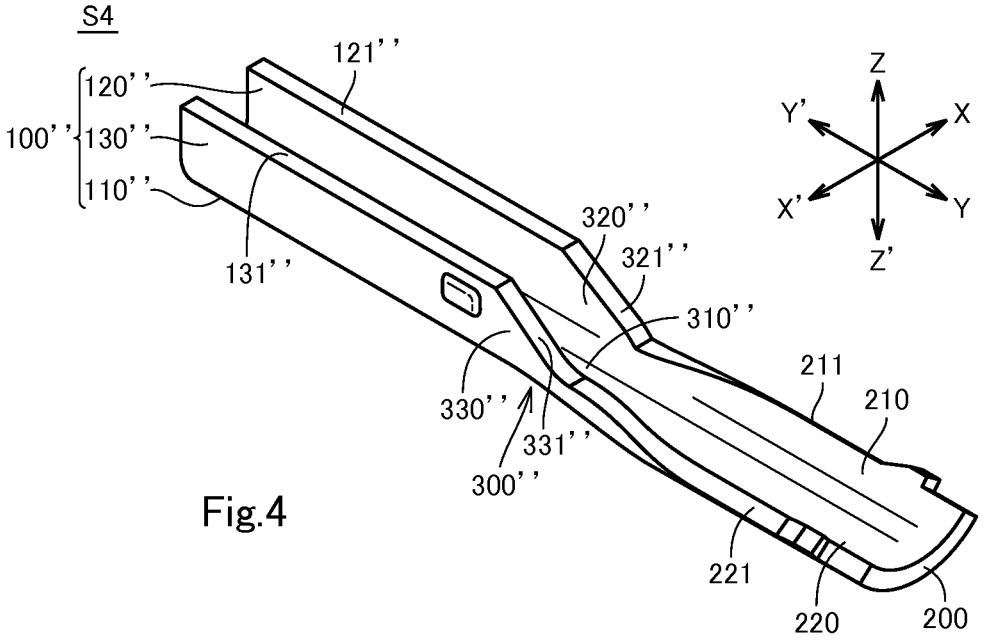
FIG. 4 is a perspective view of a contact in the fourth embodiment of the invention.

A contact S4 in accordance with the fourth embodiment of the invention will be described below with reference to FIG. 4. The contact S4 is formed of a metal plate having electrical conductivity. The contact S4 has a similar configuration as the contact S1 but includes a first connectable part 100" and a middle part 300" of different shapes from those of the first connectable part 100 and the middle part 300, respectively, of the contact S1 in the first embodiment. The differences will be described below in detail and overlapping descriptions will be omitted. The Y-Y' direction, the X-X' direction, and the Z-Z' direction are indicated in FIG. 4 in a similar manner as in the first embodiment.

The first connectable part 100" is a plate extending in the Y-Y' direction and being generally of angular U-shape in sectional view. The base 110" of the first connectable part 100" is a plate generally of angular U-shape in sectional view. The first wall 120" of the first connectable part 100" is a flat plate extending in the Z direction from the first end portion on the X-direction side of the base 110". The second wall 130" of the first connectable part 100" is a flat plate extending in the Z direction from the second end portion on the X'-direction side of the base 110". The distal face 121" of the first wall 120" and the distal face 131" of the second wall 130" face in the Z direction.

The base 310" of the middle part 300" is a plate extending in the Y-Y' direction from the base 110" of the first connectable part 100" to the second connectable part 200 and being generally of angular U-shape in sectional view. The base 310" is contiguously connected between the base 110" of the first connectable part 100" and the second connectable part 200.

The first sloped portion 320" of the middle part 300" is a plate extending in the Z direction from the first end portion on the X-direction side of the base 310". The first sloped portion 320" is contiguously connected between the first wall 120" of the first connectable part 100" and the first end portion 210 of the second connectable part 200. The first sloped portion 320" slopes down, i.e. slopes in the Y and Z' directions, from the first wall 120" to the first end portion 210 of the second connectable part 200.

The sloped face 321" of the first sloped portion 320" slopes down from the Y-direction end of the distal face 121" of the first wall 120" to the end face 211 of the first end portion 210. The first end portion 210 of the second connectable part 200 extends in the X-direction relative to the first connectable part 100". This configuration is advantageous in providing a gentle slope angle of the first sloped portion 320", i.e. lengthening the sloped face 321". As in the first embodiment, the slope angle of the first sloped portion 320" is preferably not greater than about 60 degrees, more preferably not greater than about 45 degrees, relative to the first imaginary line (not shown).

The second sloped portion 330" of the middle part 300" is a plate extending in the Z direction from the second end portion on the X'-direction side of the base 310". The second sloped portion 330" is contiguously connected between the Y-direction end of the second wall 130" of the first connectable part 100" and the second end portion 220 of the second connectable part 200. The second sloped portion 330" slopes down, i.e. slopes in the Y and Z' directions, from the second wall 130" to the second end portion 220 of the second connectable part 200.

The sloped face 331" of the second sloped portion 330" slopes down from the Y-direction end of the distal face 131" of the second wall 130" to the end face 221 of the second end portion 220. The second end portion 220 of the second connectable part 200 extends in the X'-direction relative to the first connectable part 100". This configuration is advantageous in providing a gentle slope angle of the second sloped portion 330", i.e. lengthening the sloped face 331". As in the first embodiment, the slope angle of the second sloped portion 330" is preferably not greater than about 60 degrees, more preferably not greater than about 45 degrees, relative to the second imaginary line (not shown).

The contact S4 configured as described above can be manufactured in the following manner. First, a metal plate is prepared and stamped into shape using a die not shown. More particularly, a portion on the Y' direction side of the metal plate is shaped into a generally angular U-shape in sectional view to become the first connectable part 100"; a portion on the Y direction side of the metal plate is shaped into an arc shape in sectional view to become the second connectable part 200; and a portion between the portions on the Y' and Y direction sides of the metal plate is shaped into a generally angular U-shape in sectional view to become the middle part 300".

The contact S4 can be used in a similar manner to the contact S1, more particularly as described below. A cable core or a pin not shown is inserted into the first connectable part 100" of the contact S4 to electrically and mechanically connect the first connectable part 100" to the cable core or pin. The second connectable part 200 of the contact S4 is soldered to a circuit board for mounting a connector. The second connectable part 200 may be soldered to a cable core or a pin.

The contact S4 has the same technical features and effects as those of the contact S1.

Fifth Embodiment

Figure 5:
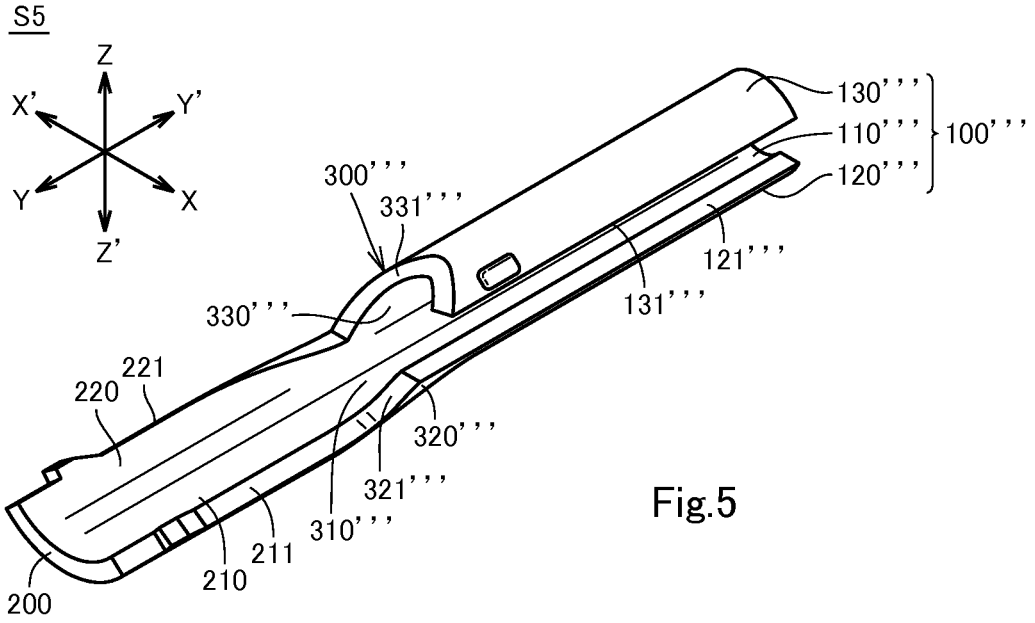
FIG. 5 is a perspective view of a contact in the fifth embodiment of the invention.

A contact S5 in accordance with the fifth embodiment of the invention will be described below with reference to FIG. 5. The contact S5 is formed of a metal plate having electrical conductivity. The contact S5 has a similar configuration as the contact S1 but includes a first connectable part 100''' and a middle part 300''' of different shapes from those of the first connectable part 100 and the middle part 300, respectively, of the contact S1 in the first embodiment. The differences will be described below in detail and overlapping descriptions will be omitted. The Y-Y' direction, the X-X' direction, and the Z-Z' direction are indicated in FIG. 5 in a similar manner as in the first embodiment.

The first connectable part 100''' is a plate extending in the Y-Y' direction and being generally of C-shape in sectional view. The base 110''' of the first connectable part 100''' is a plate of generally U-shape in sectional view. The first wall 120''' of the first connectable part 100''' is a plate of arc shaped cross-section extending from the first end portion on the X-direction side of the base in a direction containing components of the X and Z directions. The second wall 130''' of the first connectable part 100''' is a plate of arc-shaped cross-section extending from the second end portion on the X'-direction side of the base 110''', extending in the Z and X directions and then in Z' and X directions. The distal face 121''' of the first wall 120''' faces in a direction including components of X and Z directions, and the distal face 131''' of the second wall 130''' faces in a direction including components of X and Z' directions.

A base 310''' of the middle part 300''' is a plate extending in the Y-Y' direction from the base 110''' of the first connectable part 100''' to the second connectable part 200 and being arc shaped in sectional view. The base 310''' is contiguously connected between the base 110''' of the first connectable part 100''' and the second connectable part 200.

The first sloped portion 320''' of the middle part 300''' is a plate extending from the first end portion on the X-direction side of the base 310''' in a direction containing components of the X and Z directions. The first sloped portion 320''' is contiguously connected between the first wall 120''' of the first connectable part 100''' and the first end portion 210 of the second connectable part 200. The first sloped portion 320''' slopes down, i.e. slopes in the Y and Z' directions, from the first wall 120''' to the first end portion 210 of the second connectable part 200.

The sloped face 321''' of the first sloped portion 320''' slopes down from the Y-direction end of the distal face 121''' of the first wall 120''' to the end face 211 of the first end portion 210. The first end portion 210 of the second connectable part 200 extends in the X direction relative to the first connectable part 100'''. This configuration is advantageous in providing a gentle slope angle of the first sloped portion 320''', i.e. lengthening the sloped face 321'''. As in the first embodiment, the slope angle of the first sloped portion 320''' is preferably not greater than about 60 degrees, more preferably not greater than about 45 degrees, relative to the first imaginary line (not shown).

The second sloped portion 330''' of the middle part 300''' is a plate of arc-shaped cross-section, extending from the second end portion 312''' on the X'-direction side of the base 310''', extending in the Z and X directions and then in Z' and X directions. The second sloped portion 330''' is contiguously connected between the Y-direction end of the second wall 130''' of the first connectable part 100''' and the second end portion 220 of the second connectable part 200. The second sloped portion 330''' extends from the second wall 130''' to the second end portion 220 of the second connectable part 200. The second sloped portion 330''' slopes up and then slopes down, i.e. slopes in the Y and Z' directions, to the second end portion 220 of the second connectable. It should be appreciated that the second sloped portion of the invention may include slope other than downward slope as in this embodiment. The same is true for the first sloped portion.

A sloped face 331''' of the second sloped portion 330''' slopes upward from the Y-direction end of the distal face 131''' of the second wall 130''' and then slopes down to the end face 221 of the second end portion 220. As described above, the second wall 130''' of the first connectable part 100''' extends in the Z and X directions and then in Z' and X directions, and the second end portion 220 of the second connectable part 200 extends in the X' direction relative to the first connectable part 100'''. This configuration is advantageous in providing a gentle slope angle of the second sloped portion 330''', i.e. lengthening the sloped face 331'''. As in the first embodiment, the slope angle of the second sloped portion 330''' is preferably not greater than about 60 degrees, more preferably not greater than about 45 degrees, relative to the second imaginary line (not shown).

The contact S5 configured as described above can be manufactured in the following manner. First, a metal plate is prepared and stamped into shape using a die not shown. More particularly, a portion on the Y' direction side of the metal plate is shaped into a C-shape in sectional view to become the first connectable part 100'''; a portion on the Y direction side of the metal plate is shaped into an arc shape in sectional view to become the second connectable part 200; and a portion between the portions on the Y' and Y direction sides of the metal plate is shaped into a generally C-shape in sectional view to become the middle part 300'''.

The contact S5 can be used in a similar manner to the contact S1, more particularly as described below. A cable core or a pin not shown is inserted into the first connectable part 100''' of the contact S5 to electrically and mechanically connect the first connectable part 100''' to the cable core or pin. The second connectable part 200 of the contact S5 is soldered to a circuit board for mounting a connector. The second connectable part 200 may be soldered to a cable core or a pin.

The contact S5 has the same technical features and effects as those of the contact S1.

Sixth Embodiment

Figure 6:
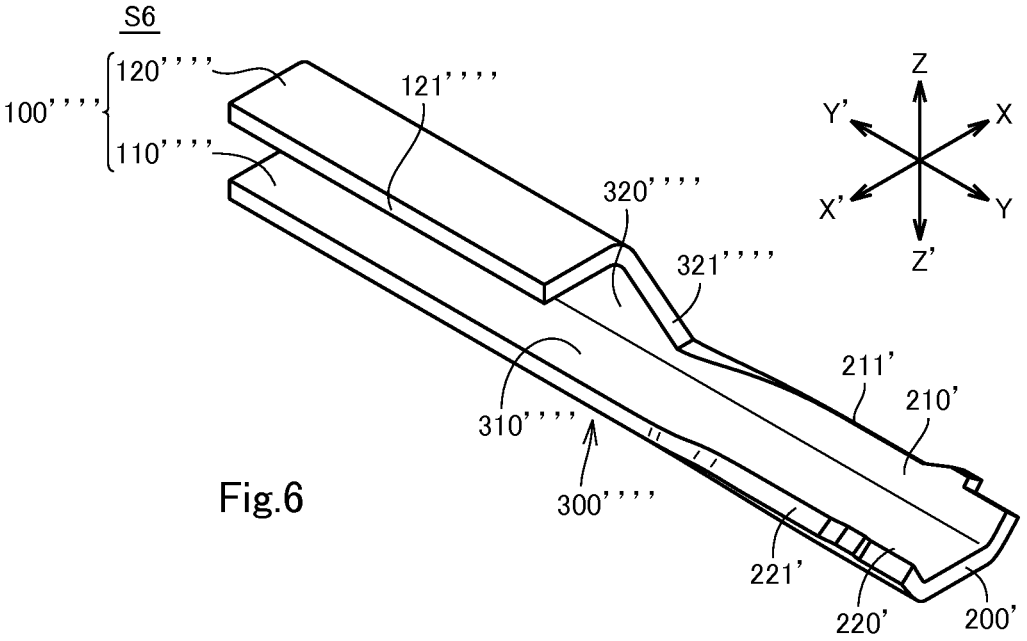
FIG. 6 is a perspective view of a contact in the sixth embodiment of the invention.

A contact S6 in accordance with the sixth embodiment of the invention will be described below with reference to FIG. 6. The contact S6 is formed of a metal plate having electrical conductivity. The contact S6 has a similar configuration as the contact S3 but includes a first connectable part 100'''' and a middle part 300'''' of different shapes from those of the first connectable part 100' and the middle part 300', respectively, of the contact S3 in the third embodiment. The differences will be described below in detail and overlapping descriptions will be omitted. The Y-Y' direction, the X-X' direction, and the Z-Z' direction are represented in FIG. 6 in a similar manner as in the third embodiment.

The first connectable part 100'''' is a plate generally of angular C-shape in sectional view and extends in the Y-Y' direction. As used herein the term "generally of C-shape in sectional view" includes a general shape of angular C-shape in sectional view. The first connectable part 100'''' includes a base 110'''' and a first wall 120''''. The base 110'''' is a plate generally of L-shape in sectional view. The first wall 120'''' is a plate extending from the first end portion on X-direction side of the base 110'''' in the Z direction and further extending in the X' direction. That is, the first wall 120'''' is bent in the X' direction.

The middle part 300'''' includes a base 310'''' and a first sloped portion 320''''. The base 310'''' is a plate extending in the Y-Y' direction from the base 110'''' of the first connectable part 100'''' to the second connectable part 200' and being generally L-shaped. The base 310'''' is contiguously connected between the base 110'''' of the first connectable part 100'''' and the second connectable part 200'.

The first sloped portion 320'''' of the middle part 300'''' is a plate extending from the first end portion on the X-direction side of the base 310'''' in the Z direction and further extending in the X' direction. That is, the first sloped portion 320'''' is bent in the X' direction. The first sloped portion 320'''' is contiguously connected between the first wall 120'''' of the first connectable part 100'''' and the first end portion 210' of the second connectable part 200'. The first sloped portion 320'''' slopes from the first wall 120'''' in a direction containing components of the Y and X directions and then slopes down, i.e. slopes in the Y and Z' directions, to the first end portion 210' of the second connectable part 200'.

The sloped face 321'''' of the first sloped portion 320'''' extends from the Y-direction end of the distal face 121'''' of the first wall 120'''' to the end face 211' of the first end portion 210', sloping in a direction containing components of the Y and X directions and then downward. As described above, the first wall 120'''' is bent in the X' direction, and the first end portion 210' of the second connectable part 200' extends in the X direction relative to the first connectable part 100. This configuration is advantageous in providing a gentle slope angle R1 of the first sloped portion 320**, i.e. lengthening the sloped face 321**. As in the first embodiment, the slope angle of the first sloped portion 320**** is preferably not greater than about 60 degrees, more preferably not greater than about 45 degrees, relative to the first imaginary line (not shown).

The contact S6 configured as described above can be manufactured in the following manner. First, a metal plate is prepared and stamped into shape using a die not shown. More particularly, a portion on the Y' direction side of the metal plate is shaped into a generally L-shape in sectional view to become the first connectable part 100; a portion on the Y direction side of the metal plate is shaped into a generally angular U-shape in sectional view to become the second connectable part 200'; and a portion between the portions on the Y' and Y direction sides of the metal plate is shaped into a generally L-shape in sectional view to become the middle part 300****.

The contact S6 is can be used in a similar manner to the contact S3, more particularly as described below. A cable core or a pin not shown is inserted into the first connectable part 100 of the contact S6 to electrically and mechanically connect the first connectable part 100** to the cable core or pin. The second connectable part 200' of the contact S6 is soldered to a circuit board for mounting a connector. The second connectable part 200'** may be soldered to a cable core or a pin.

The contact S6 has at least the following technical features and effects. First, the contact S6 can be used to transmit high-frequency signals with reduced possibility that the signals will be reflected. This is because the sloped portion 320 of the middle part 300** of the contact S6 gently slopes down from the first connectable part 100** to the second connectable part 200'. In other words, the shape of the contact S6 is such as to gently change (such as not to sharply change) at a first boundary between the first wall 120** of the first connectable part 100** and the first sloped portion 320** of the middle part 300**, and at a second boundary between the first sloped portion 320** of the middle part 300** and the first end portion 210' of the second connectable part 200'. For this reason, impedances should change gently at the first and second boundaries of the contact S6. This contributes to reduced reflection of high-frequency signals transmitted through the contact S6**.

Second, the contact S6 is designed such that the first sloped portion 320 have a gentle slope angle. More particularly, the first wall 120** of the first connectable part 100** is a plate bent as described above, and the first end portion 210' of the second connectable part 200' extends in the X direction relative to the first connectable part 100**. This configuration makes it possible to lengthen the sloped face 321** of the first sloped portion 320**, with a gentle slope angle of the first sloped portion 320****.

The contact of the invention is not limited to the above embodiments but may be modified in any manner without departing from the scope of the invention as claimed. Specific modifications will be described below in detail.

The first connectable part of the contact of the invention may be any part including a tube or plate extending in a first direction, the plate having a cross section generally of U-shape, V-shape, C-shape, or L-shape, the tube or the plate including a base having a first end portion on one side of a second direction, the second direction being orthogonal to the first direction and a first wall extending from the first end portion of the base in a direction containing a component of a third direction, the third direction being orthogonal to the first and second directions. The tube of the first connectable part may be cut out partly and have an arm extending inwardly of the tube and/or a protrusion on the inside of the tube.

If the plate of the first connectable part is generally of V-shape in sectional view, the contact preferably has the following configuration. The base of the plate of the first connectable part is a plate generally of V-shape in sectional view; the first wall extends from the first end portion of the base obliquely in a direction containing components of the one side of the second direction and the one side of the third direction; the second wall extends from the second end portion of the base obliquely in a direction containing components of the other side of the second direction and the one side of the third direction; the base of the middle part is contiguously connected between the base of the plate of the first connectable part and the second connectable part and includes a first end portion on the one side of the second direction and a second end portion on the other side of the second direction; the first sloped portion of the middle part extends from the first end portion of the base of the middle part in a direction containing components of the one side of the second direction and the one side of the third direction, is contiguously connected between the first wall of the first connectable part and the first end portion of the second connectable part, and slopes down from the first wall of the first connectable part to the first end portion of the second connectable part; the second sloped portion of the middle part extends from the second end portion of the base of the middle part in a direction containing components of the other side of the second direction and the one side of the third direction, is contiguously connected between the second wall of the first connectable part and the second end portion of the second connectable part, and slopes down from the second wall of the first connectable part to the second end portion of the second connectable part.

If the plate of the first connectable part is generally of L-shape in sectional view, the contact preferably has the following configuration. The base of the plate of the first connectable part is generally of L-shape in sectional view; the first wall extends from the first end portion of the base in the third direction; the base of the middle part is contiguously connected between the base of the first connectable part and the second connectable part and includes a first end portion on the one side of the second direction; the first sloped portion of the middle part extends from the first end portion of the base of the middle part to the one side of the third direction, is contiguously connected between the first wall of the first connectable part and the first end portion of the second connectable part, and slopes down from the first wall of the first connectable part to the first end portion of the second connectable part.

The contact S5 may have the second sloped portion 330 only, with the first sloped portion 320** omitted. In this case, the second end portion of the base 110** on X'-direction side may serve as the first end portion of the base; the second wall 130** may serve as the first wall; the second end portion 220 of the second connectable part 200 may serve as the first end portion of the second connectable part 200; and the second sloped portion 330**** may serve as the first sloped portion.

The first connectable part of the contact of the invention may have no arms or at least two arms. The at least two arms may be any arms extending in the first direction from the end on the other side in the first direction of the tube or plate of the first connectable part of any of the above aspects, being opposed to each other, and being elastically deformable in directions away from each other. Any of the first connectable parts of the contacts S1 and S3 to S6 may have at least two arms. The first connectable part including a tube or a generally C-shaped plate in sectional view may be provided with three or more arms at intervals in the circumferential direction of the tube or plate such that the arms extend in the first direction from the end on the other side in the first direction of the tube or plate.

The first connectable part of the contact of the invention may or may not include the second wall. If provided, the second wall may be any wall extending from the second end portion of the base of the first connectable part in a direction containing a component of the third direction.

The second connectable part of the contact of the invention may be any plate extending in the first direction and including a first end portion on one side of the second direction. The second connectable part may be of the same dimension in the second direction as the first connectable part. The second connectable part 200 and the second connectable part 200' are interchangeable. The second connectable part of the invention may be generally angular U-shaped or generally V-shaped in sectional view.

The middle part of the contact of the invention may be any part including a base and a first sloped portion, the base being contiguously connected between the base of the first connectable part and the second connectable part and including a first end portion on the one side of the second direction, the first sloped portion being contiguously connected between the first wall of the first connectable part and the first end portion of the second connectable part, the first sloped portion extending from the first end portion of the base of the middle part in a direction containing a component of the third direction such that the first sloped portion slopes down toward the first end portion of the second connectable part.

The middle part of the contact of the invention may or may not include the second sloped portion. If provided, the second sloped portion may be any portion being contiguously connected between the second wall of the first connectable part and the second end portion of the second connectable part and extending in a direction containing a component of the third direction from the second end portion on the other side of the second direction of the base of the middle part such that the second sloped portion slopes down toward the second end portion of the second connectable part.

It should be appreciated that the materials, shapes, dimensions, numbers, arrangements, and other configurations of the constituents of the contacts in the embodiments and the modification examples may be modified in any manner if they can perform similar functions. The embodiments and modification examples may be combined in any possible manner. The first direction of the invention may be defined in any manner as long as it is the longitudinal direction of the first connectable part of the invention. The second direction of the invention may be any direction orthogonal to the first direction. The third direction of the invention may any direction orthogonal to the first and second directions.

REFERENCE SIGNS LIST

S1: contact
100: first connectable part
110: base
111: first end portion
112: second end portion
120: first wall
121: distal face
130: second wall
131: distal face
200: second connectable part
210: first end portion
211: end face
220: second end portion
221: end face
300: middle part
310: base
311: first end portion
312: second end portion
320: first sloped portion
321: sloped face
330: second sloped portion
331: sloped face
L1: first imaginary line
L2: second imaginary line
R1: slope angle of first sloped portion
R2: slope angle of second sloped portion
Y-Y' direction: first direction
X-X' direction: second direction
Z-Z' direction: third direction

The invention claimed is:

1. A contact, comprising:

a first connectable part, being electrically connectable to a first connection object and including a tube or plate extending in a first direction, the plate having a cross section generally of U-shape, V-shape, C-shape, or L-shape, the tube or the plate including:

a base including a first end portion on one side of a second direction, the second direction being orthogonal to the first direction; and a first wall extending from the first end portion of the base in a direction containing a component of a third direction, the third direction being orthogonal to the first and second directions;

a second connectable part, being a plate and being electrically connectable to a second connection object, extending in the first direction, and including a first end portion on the one side of the second direction; and a middle part, including:

a base contiguously connected between the base of the first connectable part and the second connectable part, the base of the middle part including a first end portion on the one side of the second direction; and a first sloped portion contiguously connected between the first wall of the first connectable part and the first end portion of the second connectable part, the first sloped portion extending from the first end portion of the base of the middle part in a direction containing a component of the third direction such that the first sloped portion slopes down toward the first end portion of the second connectable part, wherein the first wall of the first connectable part has a dimension in the third direction, the first end portion of the second connectable part is provided with a wall having a dimension in the third direction that is less than ⅛ of the dimension of the first wall; and the contact is configured to transmit high-frequency signal from the first connection object to the second connection object.

2. The contact according to claim 1, wherein the first sloped portion has a slope angle of not greater than about 60 degrees relative to a first imaginary line, the first imaginary line extending in the first direction through a boundary between the first sloped portion and the first end portion of the second connectable part.

3. The contact according to claim 2, wherein the first sloped portion has a slope angle of not greater than about 45 degrees relative to the first imaginary line.

4. The contact according to claim 1, wherein the first end portion of the second connectable part extends relative to the first connectable part to the one side of the second direction or is recessed relative to the first connectable part to the other side of the second direction.

5. The contact according to claim 4, wherein the first wall of the first connectable part curves or bends to the other side of the second direction.

6. The contact according to claim 4, wherein the first wall includes a distal face facing to the other side in the second direction, the first end portion of the second connectable part includes an end face on the one side of the second direction, the first sloped portion includes a sloped face, and the sloped face extends to the one side of the second direction from an end on one side of the first direction of the distal face of the first wall of the first connectable part and then slopes down to the end face of the first end portion of the second connectable part.

7. The contact according to claim 4, wherein the first wall includes a distal face facing to in a direction including components of the other side of the second direction and the other side of the third direction, the first end portion of the second connectable part includes an end face on the one side of the second direction, the first sloped portion includes a sloped face, and the sloped face slopes up, in a direction including a component of the one side of the third direction, from an end on one side of the first direction of the distal face of the first wall of the first connectable part and then slopes down to the end face of the first end portion of the second connectable part.

8. The contact according to claim 1, wherein the first wall of the first connectable part curves or bends to the other side of the second direction.

9. The contact according to claim 1, wherein the plate of the first connectable part has a cross section generally of U-shape, V-shape, or C-shape, the base of the first connectable part further includes a second end portion on the other side of the second direction, the tube or the plate of the first connectable part further includes a second wall extending from the second end portion of the base of the first connectable part in a direction containing a component of the third direction, the second connectable part further includes a second end portion on the other side of the second direction, the base of the middle part further includes a second end portion on the other side of the second direction, and the middle part further includes a second sloped portion contiguously connected between the second wall of the first connectable part and the second end portion of the second connectable part, the second sloped portion extending from the second end portion of the base of the middle part in a direction containing a component of the third direction such that the second sloped portion slopes down toward the second end portion of the second connectable part.

10. The contact according to claim 9, wherein the first sloped portion has a slope angle of not greater than about 60 degrees relative to a first imaginary line, the first imaginary line extending in the first direction through a boundary between the first sloped portion and the first end portion of the second connectable part, and the second sloped portion has a slope angle of not greater than about 60 degrees relative to a second imaginary line, the second imaginary line extending in the first direction through a boundary between the second sloped portion and the second end portion of the second connectable part.

11. The contact according to claim 10, wherein the first sloped portion has a slope angle of not greater than about 45 degrees relative to the first imaginary line, and the second sloped portion has a slope angle of not greater than about 45 degrees relative to the second imaginary line.

12. The contact according to claim 9, wherein the second connectable part is different from the first connectable part in dimension in the second direction.

13. The contact according to claim 9, wherein the first wall of the first connectable part curves or bends to the other side of the second direction, and the second wall of the first connectable part curves or bends to the one side of the second direction.

14. The contact according to claim 13, wherein the first wall includes a distal face facing to in a direction including components of the other side of the second direction and the other side of the third direction, the first end portion of the second connectable part includes an end face on the one side of the second direction, the first sloped portion includes a sloped face, and the sloped face slopes up, in a direction including a component of the one side of the third direction, from an end on one side of the first direction of the distal face of the first wall of the first connectable part and then slopes down to the end face of the first end portion of the second connectable part.

15. The contact according to claim 9, wherein the tube or the plate of the first connectable part includes:

a first end coupled to the middle part, and a second end opposite to the first end, the first connectable part further includes at least two arms extending in the first direction from the second end of the tube or the plate, and the arms are opposed to each other and elastically deformable in directions away from each other.

16. The contact according to claim 9, wherein the first wall includes a distal face, the distal face facing in a direction including a component of the other side of the second direction or in a direction including a component of one side of the third direction, the first end portion of the second connectable part includes an end face on the one side of the second direction, the first sloped portion includes a sloped face, the sloped face of the first sloped portion slopes down from an end on one side of the first direction of the distal face of the first wall of the first connectable part to the end face of the first end portion of the second connectable part, the second wall includes a distal face, the distal face of the second wall facing in a direction including a component of the one side of the second direction or in a direction including a component of the one side of the third direction, the second end portion of the second connectable part includes an end face on the other side of the second direction, the second sloped portion includes a sloped face, and the sloped face of the second sloped portion slopes down from an end on one side of the first direction of the distal face of the second wall of the first connectable part to the end face of the second end portion of the second connectable part.

17. The contact according to claim 1, wherein the first wall of the first connectable part curves or bends to the other side of the second direction, and the second wall of the first connectable part curves or bends to the one side of the second direction.

18. The contact according to claim 1, wherein the tube or the plate of the first connectable part includes:

a first end coupled to the middle part, and a second end opposite to the first end, the first connectable part further includes at least two arms extending in the first direction from the second end of the tube or the plate, and the arms are opposed to each other and elastically deformable in directions away from each other.

19. The contact according to claim 1, wherein the first wall includes a distal face, the distal face facing in a direction including a component of the other side of the second direction or in a direction including a component of one side of the third direction, the first end portion of the second connectable part includes an end face on the one side of the second direction, the first sloped portion includes a sloped face, and the sloped face slopes down from an end on one side of the first direction of the distal face of the first wall of the first connectable part to the end face of the first end portion of the second connectable part.

20. The contact according to claim 1, wherein the first wall includes a distal face facing to the other side in the second direction, the first end portion of the second connectable part includes an end face on the one side of the second direction, the first sloped portion includes a sloped face, and the sloped face extends to the one side of the second direction from an end on one side of the first direction of the distal face of the first wall of the first connectable part and then slopes down to the end face of the first end portion of the second connectable part.

* * * * *